US006840271B2

(12) United States Patent
Obara et al.

(10) Patent No.: US 6,840,271 B2
(45) Date of Patent: Jan. 11, 2005

(54) COMPRESSOR DISCHARGE VALVE RETAINER

(75) Inventors: Richard A. Obara, Huber Heights, OH (US); Saikrishnan S. Mattancheril, Mason, OH (US); Kevin J. Gehret, Fort Loramie, OH (US); Michael J. Monnin, Vandalia, OH (US)

(73) Assignee: Copeland Corporation, Sidney, OH (US)

( * ) Notice: Subject to any disclaimer, the term of this patent is extended or adjusted under 35 U.S.C. 154(b) by 106 days.

(21) Appl. No.: 10/374,242

(22) Filed: Feb. 25, 2003

(65) Prior Publication Data

US 2004/0164268 A1 Aug. 26, 2004

(51) Int. Cl.[7] ..... F16K 15/02
(52) U.S. Cl. ..... 137/543.19
(58) Field of Search ..... 137/540, 543.19, 137/514.5; 251/368, 337; 417/567

(56) References Cited

U.S. PATENT DOCUMENTS

| | | | | |
|---|---|---|---|---|
| 886,045 | A | 4/1908 | Ehrlich | |
| 1,834,589 | A | 12/1931 | Holdsworth | |
| 1,852,033 | A | 4/1932 | Summers | |
| 2,996,155 | A | 8/1961 | Priesemuth | |
| 4,193,424 | A | 3/1980 | Hrabal | |
| 4,329,125 | A | 5/1982 | Chambers | |
| 4,352,377 | A | 10/1982 | Fritchman | |
| 4,368,755 | A | 1/1983 | King | |
| 4,445,534 | A | 5/1984 | King | |
| 4,450,860 | A | 5/1984 | Francis et al. | |
| 4,469,126 | A | 9/1984 | Simpson | |
| 4,470,774 | A | 9/1984 | Chambers | |
| 4,478,243 | A | 10/1984 | King | |
| 4,543,989 | A | 10/1985 | Lorson | |
| 4,548,234 | A | 10/1985 | Prenger | |
| 4,642,037 | A | 2/1987 | Fritchman | |
| 4,643,139 | A | 2/1987 | Hargreaves | |
| 4,696,263 | A | 9/1987 | Boyesen | |
| 4,729,402 | A | 3/1988 | Blass et al. | |
| 4,875,503 | A | 10/1989 | Heger et al. | |
| 5,016,669 | A | 5/1991 | Jamieson | |
| 5,174,735 | A | 12/1992 | Gannaway | |
| 5,192,200 | A | 3/1993 | Lilie et al. | |
| 5,213,125 | A | 5/1993 | Leu | |
| 5,277,556 | A | 1/1994 | van Lintel | |
| 5,848,882 | A | 12/1998 | Hashimoto et al. | |
| 5,934,305 | A | 8/1999 | Cho | |
| 5,960,825 | A | * 10/1999 | Scancarello et al. | 137/543.19 |
| 6,044,862 | A | 4/2000 | Schumann et al. | |
| 6,164,334 | A | 12/2000 | Wallis | |

FOREIGN PATENT DOCUMENTS

| | | |
|---|---|---|
| EP | 0 464 868 | 1/1992 |
| EP | 0 589 667 | 3/1994 |

OTHER PUBLICATIONS

European Search Report completed Jun. 4, 2004.

* cited by examiner

*Primary Examiner*—Edward K. Look
*Assistant Examiner*—John K. Fristoe, Jr.
(74) *Attorney, Agent, or Firm*—Harness, Dickey & Pierce, P.L.C.

(57) ABSTRACT

A discharge valve retainer is manufactured from powder metal using FLC4608, FL4405, FC0205 or FC0208 material. The finisher retainer has a density of approximately 6.8 to 7.6 gm/cc. The retainer is carbonitrided, quenched and tempered to achieve a surface hardness of Rockwell 15N 89-93. The exterior of the retainer is contoured to provide for the non-turbulent flow of pressurized gas around the discharge valve.

12 Claims, 5 Drawing Sheets

COMPRESSOR DISCHARGE VALVE RETAINER

FIELD OF THE INVENTION

The present invention relates generally to refrigeration compressors. More particularly, the present invention relates to a reciprocating piston type refrigeration compressor which incorporates a unique design for the discharge valve retainers which improve the reliability and the performance of the refrigeration compressor.

BACKGROUND AND SUMMARY OF THE INVENTION

Reciprocating piston type compressors typically employ suction and discharge pressure actuated valve assemblies mounted onto a valve plate assembly which is located at end of a cylinder defined by a compressor body. The valve plate assembly is typically sandwiched between a compressor head and the body of the compressor. A valve plate gasket is located between the valve plate assembly and the compressor body to seal this interface and a head gasket is located between the valve plate assembly and the compressor head to seal this interface.

The discharge valve assembly typically includes a discharge valve member which engages a valve seat defined by the valve plate assembly, a discharge valve retainer to attach the discharge valve member to the valve plate assembly and a discharge spring which is disposed between the discharge valve member and the discharge valve retainer to bias the discharge valve member into engagement with the valve seat defined by the valve plate assembly.

An important design objective for the reciprocating compressor is to minimize the re-expansion or clearance volume in the cylinder when the piston reaches top dead center. The minimizing of this re-expansion or clearance volume helps to maximize the capacity and efficiency of the reciprocating compressor. In order to minimize this re-expansion or clearance volume, the valving system and the cylinder top end wall should have a shape which is complimentary with the shape of the piston to enable the piston to reduce the volume of the compression chamber to a minimum when the piston is at top dead center of its stroke without restricting gas flow. While it may be possible to accomplish this objective by designing a complex piston head shape, manufacturing of this complex shape becomes excessively expensive, the assembly becomes more difficult and throttling losses generally occur as the piston approaches top dead center.

Prior art suction valve assemblies and discharge valve assemblies have been developed to meet the above defined design criteria relating to re-expansion or clearance volume and these valve assemblies have performed satisfactory in the prior art compressors.

One area that can provide additional benefits to the reciprocating piston type compressors is in the area of compressed gas flow. As the piston begins its compression stroke, the gas within the compression chamber is compressed and eventually the discharge valve assembly opens to allow the compressed gas to flow into the discharge chamber. The compressed gas must flow past all of the components of the discharge valve assembly and thus the design of these components are critical to ensure that the flow of compressed gas is not restricted and therefore any throttling losses are reduced or eliminated.

The present invention provides the art with a unique design for the discharge valve retainer which improves gas flow to minimize and/or eliminate throttling losses associated with the compressed gas flow. The discharge valve retainer of the present invention is manufactured using a powder metal process utilizing a retainer material and density that define and optimize the retainer's structural, reliability and performance. In addition, the geometry of the discharge valve retainer has been optimized to deliver the best performance.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
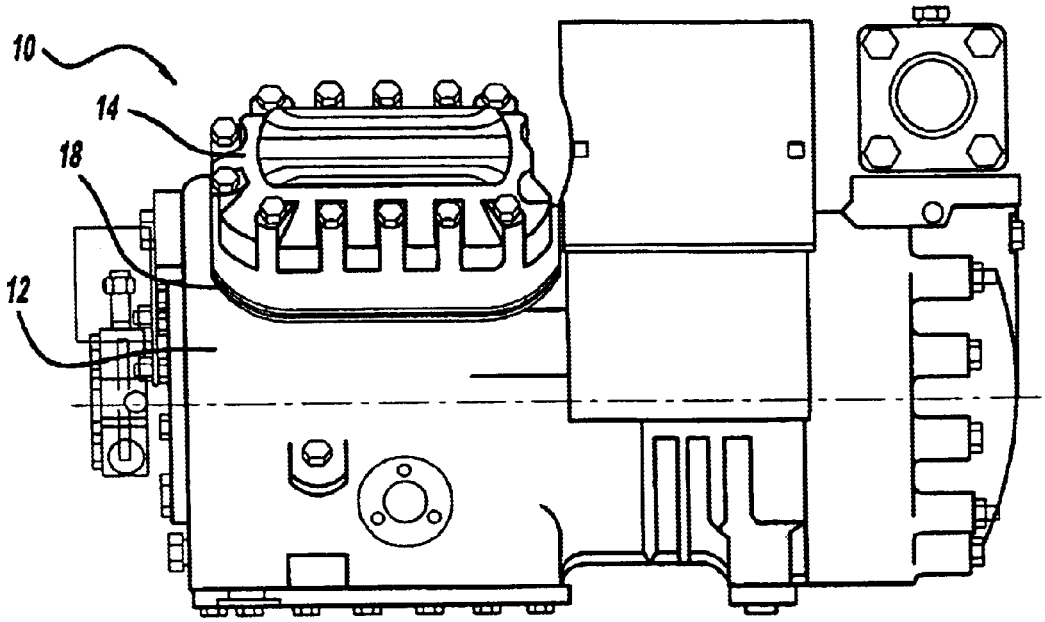
FIG. 1 is a side view of a compressor assembly incorporating the unique discharge valve retainer in accordance with the present invention.
Figure 2:
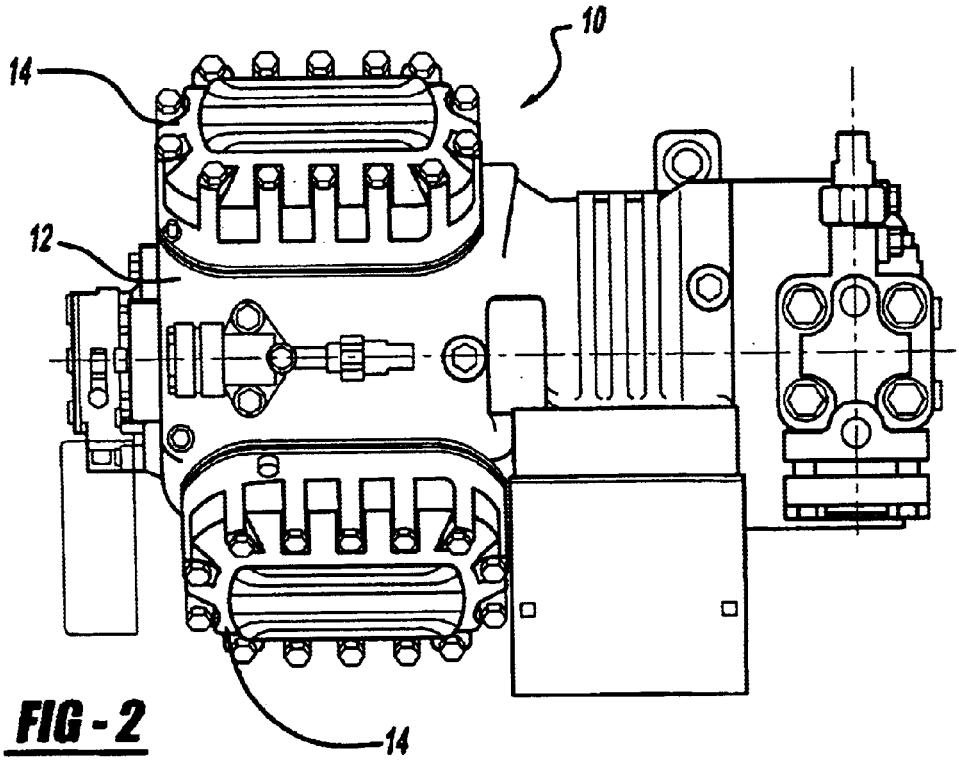
FIG. 2 is a top view of the compressor assembly illustrated in FIG. 1.
Figure 3:
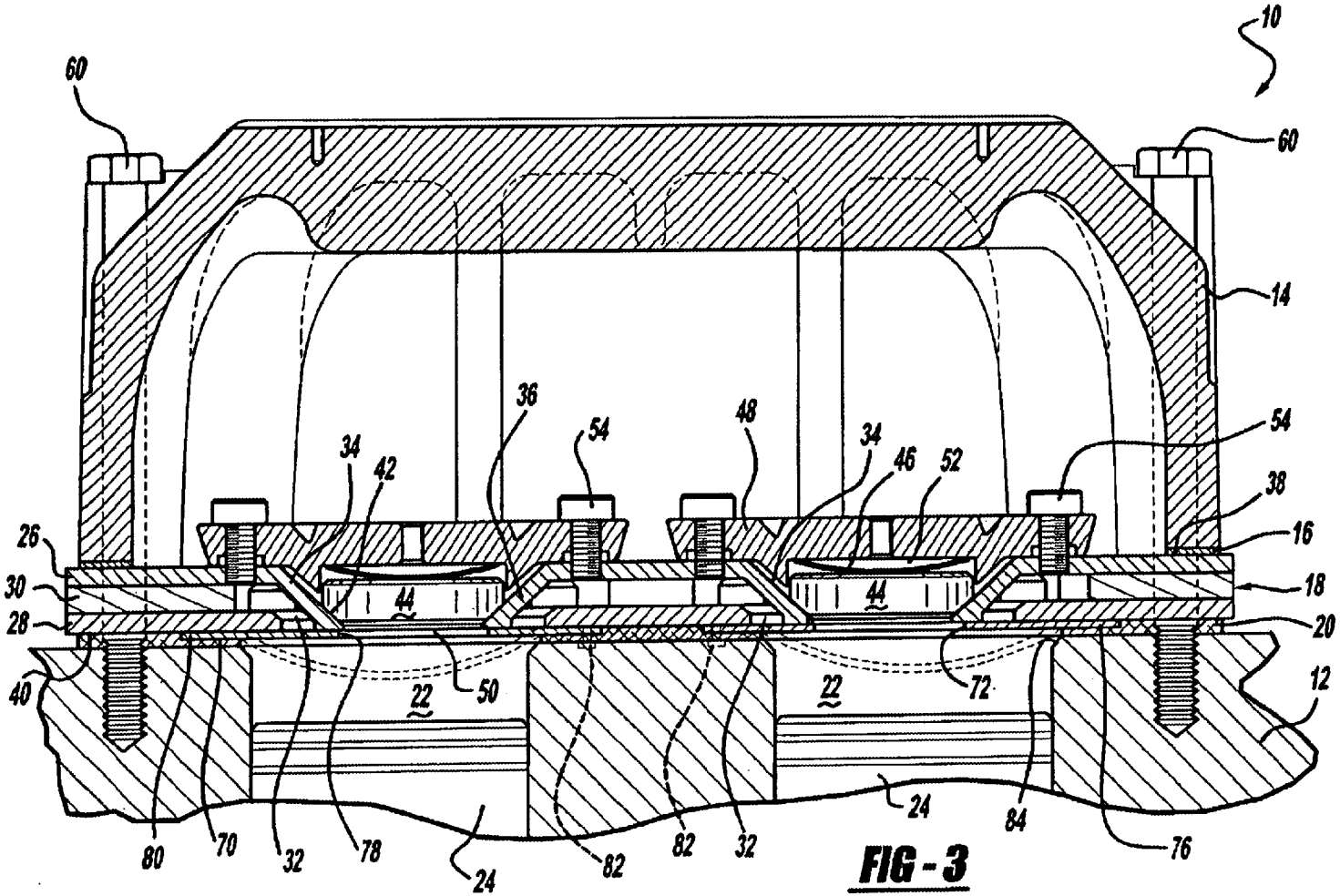
FIG. 3 is a partial cross-sectional view through the compressor assembly illustrated in FIGS. 1 and 2 where each cylinder is shown rotated 90° about a central axis.
Figure 5:
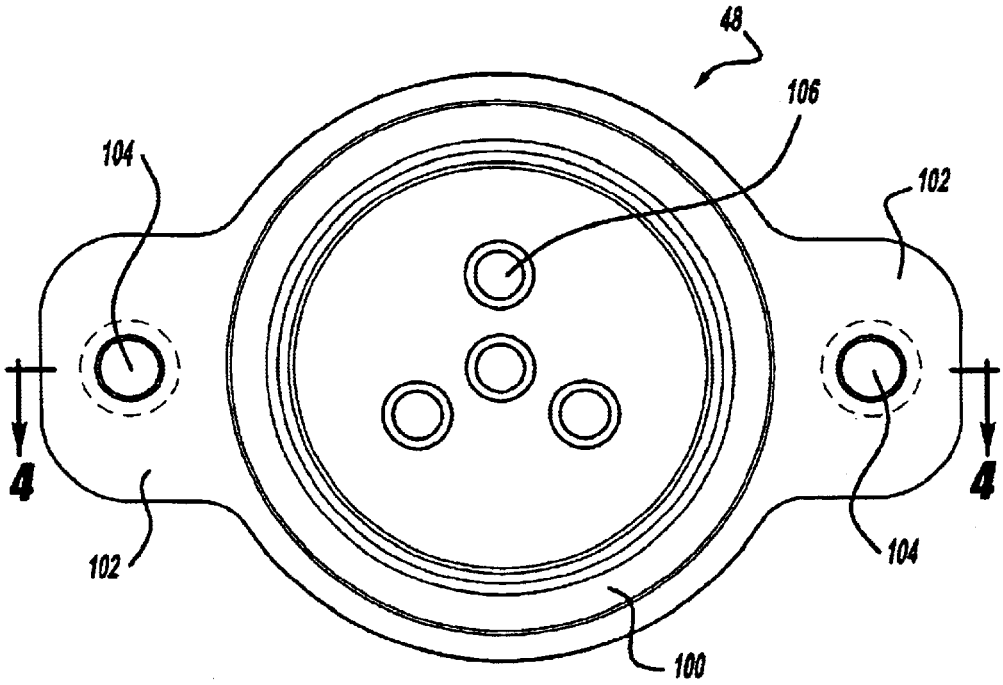
FIG. 5 is a top view of the discharge valve retainer illustrated in FIG. 4.
Figure 4:
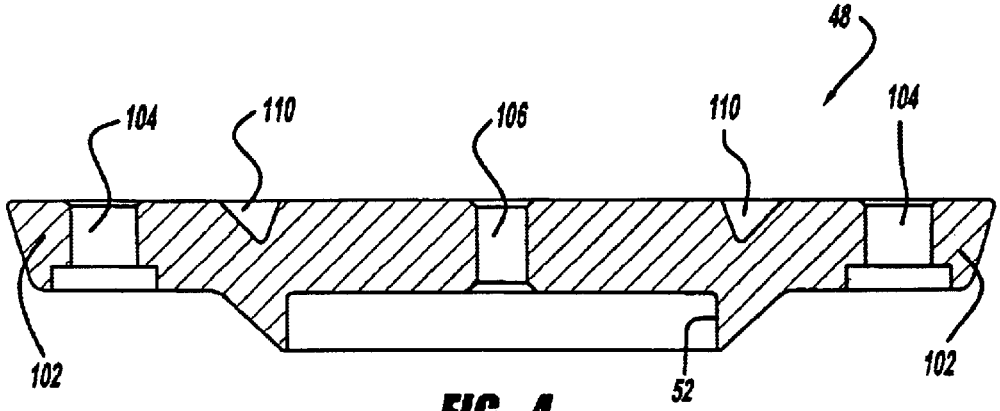
FIG. 4 is a side cross-sectional view of the discharge valve retainer illustrated in FIG. 3 taken through the central body and the flanges of the retainer.
Figure 6:
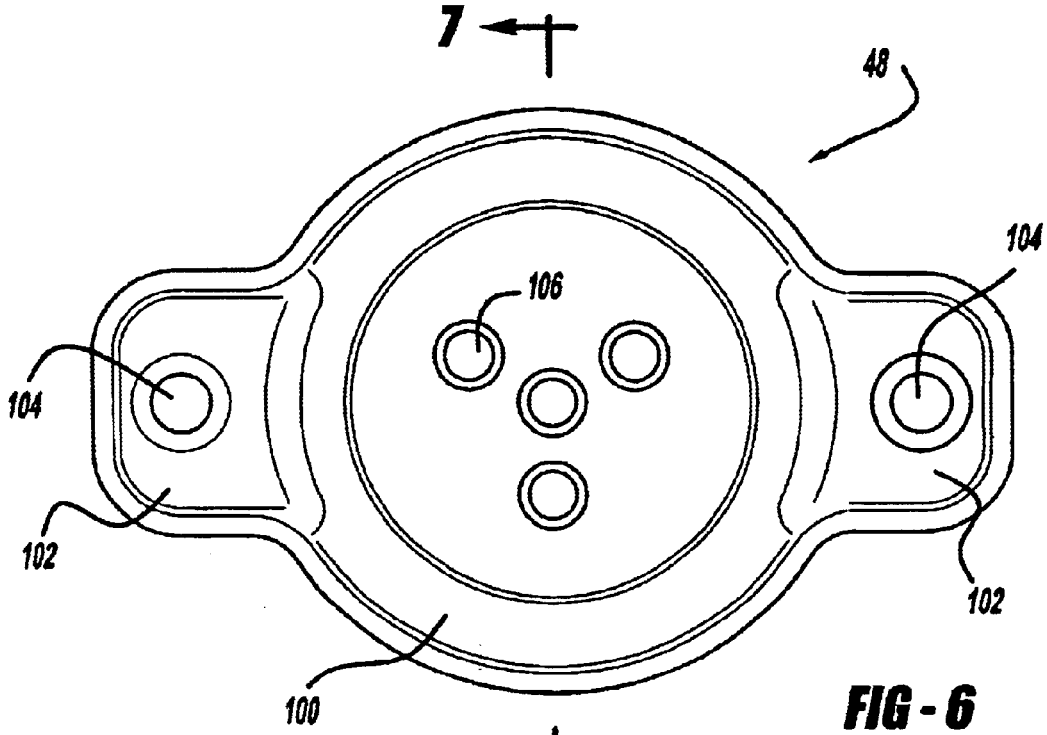
FIG. 6 is a bottom view of the discharge valve retainer illustrated in FIG. 4.

The following description of the preferred embodiment(s) is merely exemplary in nature and is in no way intended to limit the invention, its application, or uses. There is shown in FIGS. 1–8 a compressor assembly 10 which incorporates the unique discharge valve retainer in accordance with the present invention. Compressor assembly 10 comprises a compressor body 12, a compressor head 14 a head gasket 16, a valve plate assembly 18 and a valve plate gasket 20.

Compressor body 12 defines a pair of compression cylinders 22 within which a piston 24 is slidably disposed. Each compression cylinder 22 is in communication with both a discharge chamber and a suction chamber through valve plate assembly 18.

Valve plate assembly 18 comprises an upper valve plate 26, a lower valve plate 28, and an annular spacer 30. Valve plate assembly 18 defines a pair of suction passages 32 which is in communication with the suction chamber of compression assembly 10 and a pair of discharge passages 34 which are in communication with the discharge chamber of compressor assembly 10. Each discharge passage 34 is defined by a radially inclined or beveled sidewall 36 extending between an upper surface 38 and a lower surface 40 of valve plate assembly 18. Beveled sidewall 36 is formed from upper valve plate 26. A surface 42 of side wall 36 provides a valve seat for a discharge valve member 44 which is urged into sealing engagement therewith by discharge gas pressure and a spring 46 extending between discharge valve member 44 and a bridge-like retainer 48.

As shown, discharge valve member 44 is of a size and a shape relative to discharge passage 34 so as to place a lower surface 50 thereof in substantially coplanar relationship to lower surface 40 of valve plate assembly 18. Spring 46 is located in a recess 52 provided in retainer 48. Discharge valve member 44 is essentially pressure actuated and spring 46 is chosen primarily to provide stability and also to provide an initial closing bias or preload to establish an initial seal. Other types of springs, other than that illustrated may of course be used for this purpose. Retainer 48, which also serves as a stop to limit the opening movement of valve member 44 is secured to valve plate assembly 18 by a pair of suitable fasteners 54.

Annular spacer 30 is disposed between upper valve plate 26 and lower valve plate 28 and annular spacer 30 forms suction passage 32 with upper valve plate 26 and lower valve plate 28. Valve plate assembly 18 is secured to compressor body 12 when compressor head 14 is secured to compressor body 12. Valve plate assembly 18 is sandwiched between compressor head 14 and compressor body 12 with valve plate gasket 20 being sandwiched between valve plate assembly 18 and compressor body 12 and head gasket 16 being sandwiched between valve plate assembly 18 and compressor head 14.

A plurality of bolts 60 extend through compressor head 14, head gasket 16, upper valve plate 26 of valve plate assembly 18, annular spacer 30 of valve plate assembly 18, lower valve plate 28 of valve plate assembly 18, valve plate gasket 20 and are threadingly received by compressor body 12. The tightening of bolts 60 compresses valve plate gasket 20 to provide a sealing relationship between valve plate assembly 18 and compressor body 12 and compresses the head gasket 16 to provide a sealing relationship between valve plate assembly 18 and compressor head 14.

Valve plate assembly 18 defines an annular valve seat 70 and sidewall 36 defines an annular valve seat 72 located at its terminal end. Disposed between valve seat 70 and valve seat 72 is suction passage 32.

Valve seat 72 of sidewall 36 is positioned in coplanar relationship with valve seat 70 of valve plate assembly 18. A suction reed valve member 76 in the form of an annular ring sealingly engages, in its closed position, valve seat 72 of sidewall 36 and valve seat 70 of valve plate assembly 18 to prevent passage of fluid from compression cylinder 22 into suction passage 32. A central opening 78 is provided in suction reed valve member 76 and is arranged coaxially with discharge passage 34 so as to allow direct gas flow communication between compression cylinder 22 and lower surface 50 of discharge valve member 44. Suction reed valve member 76 also includes a pair of diametrically opposed radially outwardly extending tabs 80. One tab 80 is used to secure reed valve member 76 to valve plate assembly 18 using a pair of drive studs 82.

As piston 24 within compression cylinder 22 moves away from valve plate assembly 18 during a suction stroke, the pressure differential between compression cylinder 22 and suction passage 32 will cause suction reed valve member 76 to deflect inwardly with respect to compression cylinder 22, to its open position (shown in dashed lines in FIG. 3), thereby enabling gas flow from suction passage 32 into compression cylinder 22 between valve seats 70 and 72. Because only tabs 80 of suction reed valve member 76 extend outwardly beyond the sidewalls of compression cylinder 22, suction gas flow will readily flow into compression cylinder 22 around substantially the entire inner and outer peripheries of suction reed valve member 76. As a compression stroke of piston 24 begins, suction reed valve member 76 will be forced into sealing engagement with valve seat 70 and valve seat 72. Discharge valve member 44 will begin to open due to the pressure within compression cylinder 22 exceeding the pressure within discharge passage 34 and the force exerted by spring 46. The compressed gas will be forced through central opening 78, past discharge valve member 44 and into discharge passage 34. The concentric arrangement of valve plate assembly 18 and reed valve member 76 allow substantially the entire available surface area overlying compression cylinder 22 to be utilized for suction and discharge valving and porting, thereby allowing maximum gas flow both into and out of compression cylinder 22.

The continuous stroking of piston 24 within compression cylinder 22 continuously causes suction reed valve member 76 and discharge valve member 44 to move between their open and closed positions. Compressor body 12 includes an angled or curved portion 84 at the outer edge of compression cylinder 22 adjacent the free end of suction reed valve member 16 to provide a friendly surface for suction reed valve member 76 to bend against, thereby significantly reducing the bending stresses generated within the free end tab 80.

Referring now to FIGS. 4–9, the present invention is directed towards the unique design for discharge valve retainer 48. Discharge valve retainer 48 comprises a circular central body 100 and a pair of radially outward extending flanges 102.

Each flange 102 defines a bore 104 which is utilized to secure discharge valve retainer 48 to valve plate assembly 18 using a respective fastener 54.

Circular central body 100 defines recess 52 within which spring 46 is located. A plurality of bores 106 located within recess 52 extend through circular central body 100. Bores 106 allow for flow of compressed discharge gas to facilitate the movement of discharge valve member 44 and spring 46 as well as to direct the pressurized gas to the back side of discharge valve member 44 to bias discharge valve member 44 against the valve seat defined by surface 42 of sidewall 36.

An annular recess 110 extends into circular central body opposite to the side which defines recess 52. Recess 110 provides for a more consistent wall thickness for discharge valve retainer which helps to achieve uniform part density, particularly in the top edge, which is a critical requirement for the functionality of the retainer.

Figure 7:
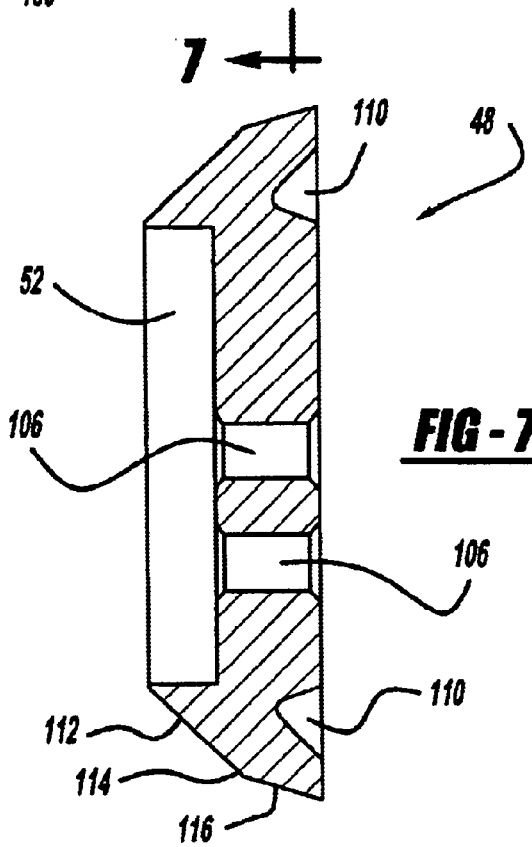
FIG. 7 is a side cross-sectional view of the discharge valve retainer illustrated in FIG. 3 taken through the central body of the retainer.
Figure 8:
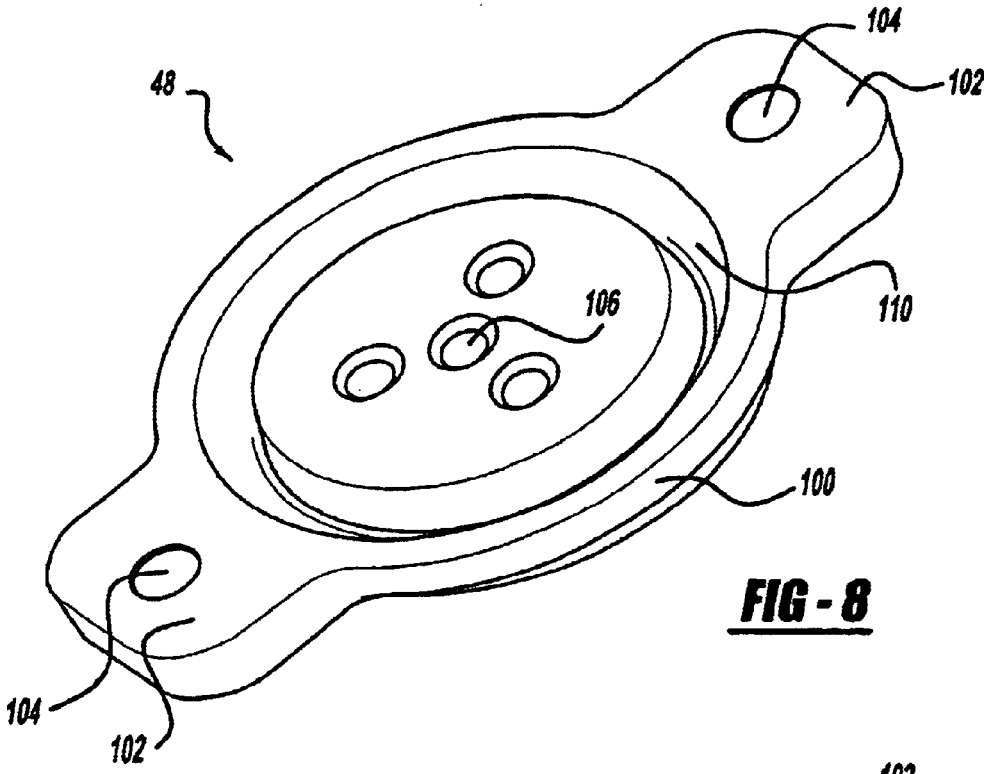
FIG. 8 is a top perspective view of the discharge valve retainer illustrated in FIG. 4.
Figure 9:
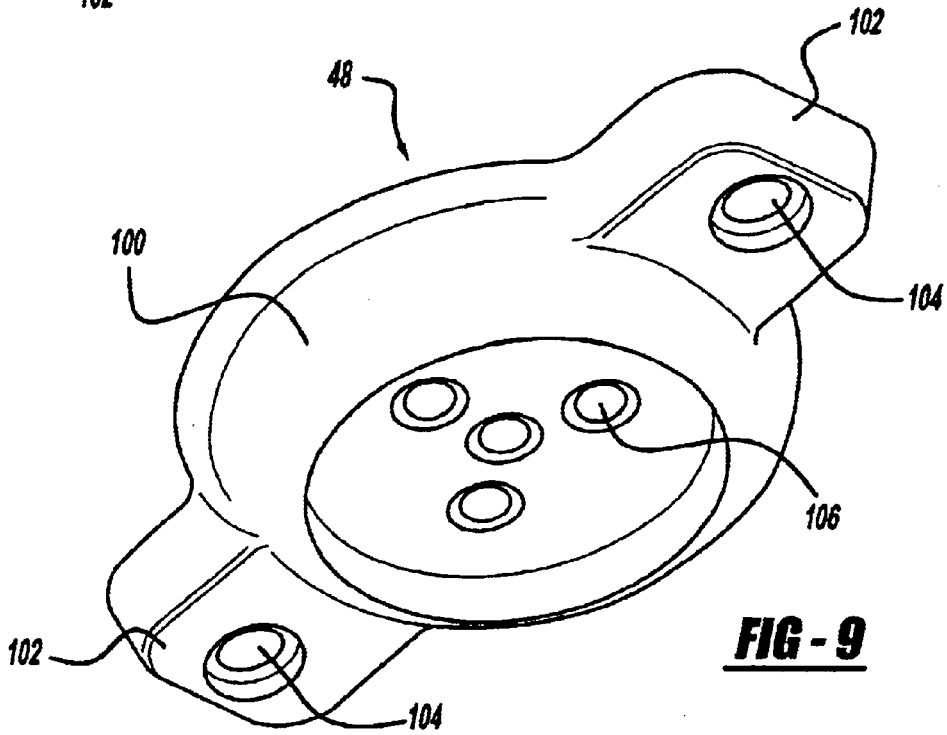
FIG. 9 is a bottom perspective view of the discharge valve retainer illustrated in FIG. 4.

Referring now specifically to FIG. 7, the exterior configuration of circular central body 100 is illustrated. The exterior configuration of circular central body 100 is designed to provide better discharge gas flow which translates into less turbulence and thus better compressor performance. Starting at the top of recess 52, the exterior configuration of central body 100 comprises a first contoured surface in the form of a first frusto-conical wall 112, a blending portion 114 and a second contoured surface in the form of a second frusto-conical wall 116. In the preferred embodiment, first frusto-conical wall 112 forms a 450 angle with the axial direction of discharge valve retainer 48 and the second frusto-conical wall 116 forms a 15° angle with the axial direction. The preferred blending portion 114 is a 0.250 inch radius. The axial direction of discharge valve retainer 48 is the axial direction of bores 106.

The preferred material for producing discharge valve retainer 48 from powder metal is a low alloy steel powder pre alloyed with 1.5 weight percent molybdenum and 0.2 weight percent carbon in the matrix (obtained by prealloying or admixing graphite). This material is available form Hoeganaes Corporation under the tradename Ancorsteel® 150 HP or from Hoganas AB, under tradename Astaloy Mo. which provides optimal structural properties with a preferred part density of approximately 6.8 to 7.6 gm/cc and more preferably with a part density of approximately 7.6 gm/cc. While the above described material is preferred material, alternate materials that may be used for discharge valve retainer 48 include but are not limited to FLC4608, FL4405, FC0205 and FC0208.

Because surface hardness and functional strength are critical to the reliability and performance of discharge valve retainer 48, carbonitriding, quenching and tempering of discharge valve retainer 48 is preferred to provide a surface hardness to Rockwell 15N 89-93.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A discharge valve assembly for a compressor, said discharge valve assembly comprising a valve plate assembly defining a discharge valve seat;

a discharge valve member movable between a closed position where said discharge valve member engages said discharge valve seat and an open position where said discharge valve member is spaced from said discharge valve seat;

a biasing member urging said discharge valve member into its closed position;

a retainer attached to said valve plate assembly overlying said discharge valve member to limit opening movement of said discharge valve member, said retainer comprising:

a circular central body defining a recess extending into a bottom surface of said central body within which said discharge valve member and said biasing member are disposed;

a pair of flanges extending radially outwardly from said circular central body, each of said pair of flanges defining a bore for attaching said retainer to said valve plate assembly; and an annular recess extending into a top surface of said central body, said annular recess defining a more consistent wall thickness for said retainer.

2. The discharge valve assembly according to claim 1 wherein said retainer is manufactured from a powder metal material.

3. The discharge valve assembly according to claim 2 wherein said retainer has a density of approximately 6.8 to 7.6 gm/cc.

4. The discharge valve assembly according to claim 3 wherein said retainer has a surface hardness of Rockwell 15N 89-93.

5. The discharge valve assembly according to claim 1 wherein said retainer is manufactured from powder metal material and said retainer has a density of approximately 6.8 to 7.6 gm/cc.

6. The discharge valve assembly according to claim 1 wherein said central body defines an outer surface having a first contoured surface, a second contoured surface and a blending portion disposed between said first and second contoured surfaces.

7. The discharge valve assembly according to claim 6 wherein said first contoured surface is a frusto-conical surface.

8. The discharge valve assembly according to claim 7 wherein said second contoured surface is a frusto-conical surface.

9. The discharge valve assembly according to claim 6 wherein said retainer is manufactured from a powder metal material.

10. The discharge valve assembly according to claim 9 wherein said retainer has a density of approximately 6.8 to 7.6 gm/cc.

11. The discharge valve assembly according to claim 10 wherein said retainer has a surface hardness of Rockwell 15N 89-93.

12. The discharge valve assembly according to claim 6 wherein said retainer is manufactured from powder metal material and said retainer has a density of approximately 6.8 to 7.6 gm/cc.

* * * * *

UNITED STATES PATENT AND TRADEMARK OFFICE

CERTIFICATE OF CORRECTION

PATENT NO. : 6,840,271 B2
DATED : January 11, 2005
INVENTOR(S) : Richard A. Obara et al.

It is certified that error appears in the above-identified patent and that said Letters Patent is hereby corrected as shown below:

Column 5,
Line 1, "450" should be -- 45° --.

Signed and Sealed this

Twenty-sixth Day of April, 2005

JON W. DUDAS
*Director of the United States Patent and Trademark Office*